US005624615A

United States Patent [19]

Sandorff

[11] Patent Number: 5,624,615

[45] Date of Patent: Apr. 29, 1997

[54] METHOD OF MANUFACTURING MODULAR STONE PANELS

[76] Inventor: Daniel R. Sandorff, 145 Raritan River Rd., Califon, N.J. 07830

[21] Appl. No.: 521,038

[22] Filed: Aug. 29, 1995

[51] Int. Cl.[6] ..... B28B 1/08; B28B 1/16

[52] U.S. Cl. ..... 264/71; 264/247; 264/251; 264/254; 264/256; 264/264; 264/277; 264/278; 264/279

[58] Field of Search ..... 264/71, 247, 277, 264/278, 279, 279.1, 233, 251, 254, 256, 264

[56] References Cited

U.S. PATENT DOCUMENTS

| | | | |
|---|---|---|---|
| 346,734 | 8/1886 | Daniels . | |
| 738,643 | 9/1903 | Van Camp . | |
| 792,979 | 6/1905 | Fulghum . | |
| 1,169,985 | 2/1916 | Mickelson . | |
| 1,211,632 | 1/1917 | Shaw et al. | 264/279 X |
| 1,239,762 | 9/1917 | Benners | 264/279 |
| 1,691,721 | 11/1928 | Johnson | 264/277 X |
| 1,748,505 | 2/1930 | Bemis . | |
| 1,809,504 | 6/1931 | Carvel | 264/35 |
| 1,838,203 | 12/1931 | Wales . | |
| 1,877,898 | 9/1932 | Kotrbaty . | |
| 1,916,308 | 7/1933 | Grieco . | |
| 2,047,648 | 4/1936 | Pollard | 72/37 |
| 2,141,397 | 12/1938 | Locke | 72/40 |
| 2,149,784 | 3/1939 | McClatchy et al. | 72/35 |
| 2,151,420 | 3/1939 | Carvel | 72/16 |
| 2,194,047 | 3/1940 | Markle | 72/43 |
| 2,467,590 | 4/1949 | Johnson | 264/277 X |
| 2,474,654 | 6/1949 | Carlson | 25/155 |
| 2,668,435 | 2/1954 | Clements | 72/41 |
| 2,701,959 | 2/1955 | Briggs | 72/42 |
| 2,810,180 | 10/1957 | Barnack | 25/1 |
| 2,811,850 | 11/1957 | Clary . | |
| 2,890,492 | 6/1959 | Smith | 264/71 |
| 3,228,084 | 1/1966 | Coleman et al. | 25/142 |

(List continued on next page.)

FOREIGN PATENT DOCUMENTS

| | | | |
|---|---|---|---|
| 2839704 | 3/1980 | Germany . | |
| 356516 | 2/1938 | Italy . | |
| 0551154 | 11/1956 | Italy . | |
| 227403 | 12/1984 | Japan | 264/279.1 |
| 104507 | 4/1993 | Japan | 264/247 |
| 491397 | 9/1938 | United Kingdom | 264/277 |
| 732431 | 6/1955 | United Kingdom . | |
| 2211181 | 6/1989 | United Kingdom | 264/71 |

*Primary Examiner*—Karen Aftergut
*Attorney, Agent, or Firm*—Eckert Seamans Cherin & Mellott

[57] ABSTRACT

Modular stone panels simulate assembled masonry, and are useful for decorative walls, retaining walls, facings for structures and the like. Precast stone-faced panels are made by setting stones such as field stone having at least one relatively flat face, substantially directly on the bottom of a rectangular mold. The stones are set in the mold individually while packing sand around and between the stones but not under them. This is done by sliding each stone laterally across the bottom of the mold, thereby packing the sand while substantially keeping the stones supported immovably against the bottom. The stones do not float on a sand bed and the sand between them is packed. Thus the stone and sand are less readily displaced by concrete poured over them to fill the mold. The concrete bonds part way into the packed sand, which can be facilitated by vibration, causing a liquid portion of the concrete to diffuse into the sand. Retaining rods are carried on coil threaded rods that are removed to provide either points of attachment for mounting or lifting, or as weep holes. The retaining rods can extend into edge cavities and preferably into tubular receptacles, filled with concrete to lock joints between adjacent panels. For making corners, alternating stones protrude from the concrete in a first cast panel, and are interleaved with stones when casting a next panel so as to extend around the corner in lieu of a solid concrete strip. The stone facing can extend over only a part of the panel height, particularly for retaining walls, which can be passively braced using the threaded point of attachment and a buried anchor such as an automobile tire.

12 Claims, 6 Drawing Sheets

U.S. PATENT DOCUMENTS

| | | | |
|---|---|---|---|
| 3,331,175 | 7/1967 | Terrio | 52/315 |
| 3,390,496 | 7/1968 | Weiner et al. | 52/232 |
| 3,441,457 | 4/1969 | Regnaud | 264/247 X |
| 3,503,165 | 3/1970 | Hardt | 52/125 |
| 3,646,715 | 3/1972 | Pope | 52/309 |
| 3,650,079 | 3/1972 | Lubin | 52/316 |
| 3,732,653 | 5/1973 | Pickett | 52/71 |
| 3,874,139 | 4/1975 | Landowski | 52/251 |
| 3,874,140 | 4/1975 | Seehusen | 52/315 |
| 4,219,984 | 9/1980 | de San | 52/741 |
| 4,285,179 | 8/1981 | Goidinger | 52/309.12 |
| 4,290,246 | 9/1981 | Hilsey | 52/169.1 |
| 4,915,888 | 4/1990 | Sato | 264/71 |
| 5,359,816 | 11/1994 | Iacouides | 52/274 |

METHOD OF MANUFACTURING MODULAR STONE PANELS

BACKGROUND OF THE INVENTION

1. Field of the Invention

The invention relates to the field of building panels, in particular precast wall or facing panels of the type made by setting stones in an array and casting concrete around only a rear part of the stones. The concrete bonds to the stones, leaving front or outer sides of the stones exposed between gaps resembling mortar joints. When the panel is erected, the resulting wall or facing has the appearance of a masonry wall that was assembled stone by stone using mortar. The invention additionally concerns the formation of corners in such structures and further provides means by which embedded coil threaded structures that support reinforcing rods during casting are used for mounting the panels to one another or to other structures.

2. Prior Art

It is known to precast individual panels and to mount them to a structure, or to abut the panels edgewise to form a wall, a facing for a wall, a paving element or a similar structure, using the panels as modular building elements. Such panels are cast in a shallow horizontal mold and can be installed horizontally, vertically or otherwise as appropriate. According to one concrete casting technique for making panels, a number of stones, bricks, blocks or the like are set in an array in a frame-like mold containing a loose material such as sand or a removable material such as wax, leaving spaces between the stones occupied by the removable material. Concrete is poured over the stones and allowed to cure, bonding to the inner or rear faces of the stones and to the sides of the stones along the spaces. The idea is that the sand or other loose or removable material will keep the poured concrete from reaching the front or outer faces of the stones, blocks or the like, so that the faces will be exposed after the concrete has cured and the panel is lifted out of the mold, and cleaned of the removable material. This technique is applicable to various stone and block materials and various different shapes, all such stones, blocks and the like being termed simply "stones" in this disclosure.

Typically, a bed of sand is placed in the mold and the surface of the sand is levelled to provide a uniform depth. The stones are laid vertically upon and pushed downwardly into the bed of sand. Sand also can be poured or brushed into the spaces between the stones, instead of or in addition to using an initial levelled bed of sand. The sand or other removable material is placed to the required depth to control the extent to which the stones or blocks protrude from the finished casting. Whereas the stones or blocks are slightly spaced from one another and protrude from the concrete in the finished product, the panel resembles a masonry structure in which the stones or blocks were assembled using mortar joints.

Casting various types of panels using various types of stones or blocks in the foregoing manner is disclosed, for example, in U.S. Pat. Nos. 1,169,985—Mickelson; 1,916,308—Grieco; 2,151,420—Carvel; 3,390,496—Weiner et al.; and, 3,874,140—Seehusen. In U.S. Pat. No. 2,047,648—Pollard, such a block is cast vertically using straw or dried mud as the material for keeping the concrete from flowing onto the outer faces of the embedded stones. Additional related disclosures are found in U.S. Pat. Nos. 1,838,203—Wales; 2,149,784—McClatchy et al.; 2,151,420—Carvel; 3,331,175—Terrio; 3,646,715—Pope; 4,219,984—de San; German Patent 2,839,704—Sickau; British Patent 732,431—Davie et al.; and Italian Patents 356,516 and 551,154.

Although forming a precast simulation of an assembled masonry wall as described appears to be a straightforward operation, problems are encountered in practice. A primary problem is that when pouring concrete over the array of stones in the sand bed, it is difficult to prevent the concrete from flowing through the removable material and/or around the stones to the front face of the stones, where the intruding concrete ruins the effect. Part of the problem is the tendency of the thick and heavy poured concrete aggregate to displace either or both of the sand in the sand bed and the stones set therein. Displacement of the sand and stones opens flow paths, resulting in intrusions of the concrete into isolated areas between and on the front faces of the stones. Another aspect is that the sand mixes with the concrete and becomes part of the concrete aggregate. If the concrete is allowed to set when wholly or partly covering the front face of one or more stones, either it must be chipped or cleaned away, or the cast panel will be unsightly and wasted. Normally the sand adhering to the concrete provides a particular colored appearance (e.g., tan). If the concrete intrudes into the spaces between the stones, by displacing the sand, the distinct color of the intruding concrete (e.g., gray) is likewise noticeable and unsightly.

A less easily displaced material such as liquid wax or mud can be used instead of sand and allowed to harden before casting the concrete, but such materials are inconvenient. Any misplaced material applied to the rear part of the stones interferes with bonding between the stones and the concrete. Cleanup after casting is a problem for these less-easily displaced materials. Even using sand, efforts may be required to remove sand or sand/cement aggregate between the stones, or to dress up the appearance of the panel by pointing or the like.

In the conventional technique, a bed of sand deeper than the desired distance by which the stones are to protrude, is first placed in the mold. The stones are laid on the sand bed. The stones depress the sand underneath the stones, but sand remains under each stone, the stones "floating" on the sand bed. Natural stone usually is be at least somewhat rounded or tapered toward the edges, with the result that the sand under the middle of each stone is most compressed (but remains between the stone and the bottom of the casting mold); the sand spaced from the middle is less compressed; and the sand in spaces between the stones is not compressed at all. Thus the stones and sand are not stable nor are they evenly packed.

It is possible to add sand to the spaces between the stones after the stones are in place, for example by pouring additional sand over the laid stones and brushing the sand off the rear faces of the stones and into the spaces between the stones. However, it is difficult or impossible adequately to pack the sand between and under the rounded parts of the stones, which areas are inaccessible due to the presence of the stones and their rounded shape. In fact compressing the sand by simply laying the stones on a sand bed tends to form a pedestal of compressed sand under the center of the stone and uncompressed sand around its perimeter, which is unstable. This is not remedied simply by wiggling the stone when placing it, because sand remains under the stone. Wiggling stones when placing them also disturbs adjacent stones and sand, as well as causing uneven inter-stone spacing that is inconsistent with the traditional masonry appearance, wherein great effort is expended to space the stones evenly.

Another problem is how to resolve the presence of the stones, sand and concrete with the structural needs and practical problems encountered in building using precast panels generally. These problems include providing good structural strength and appropriate means for handling the panels when cured. A cast panel may weigh on the order of 2,000 to 3,000 lbs. (900–1,400 kg).

Other problems include how to join coplanar panels in endwise abutting relationships without extremely apparent seams and/or how to mount the panels, for example facewise to a surface such as a vertical wall or to enclose a column. Advantageously, the panels should be adaptable to various different types and shapes of structures that are advantageously faced with stone.

Another problem is how to form corners, particularly since the rear face of the panel is concrete and the edge of at least one of the two panels at a corner normally will be visible when two panels are abutted, for example at 90°. Visible edges and seams detract from the objective of simulating an assembled masonry wall. Seams and edges are a problem at corners and where panels are needed to face around polygonal shapes such as corner posts, monuments or chimneys, due to the layered structure of the panels. The layered planar structure is inconsistent with forming corners and three dimensional forms such as three panel channels (e.g., to face a chimney), boxes and non-rectilinear forms.

It would be advantageous if these matters could be resolved in a reinforced panel that can be constructed in a convenient and effective manner.

SUMMARY OF THE INVENTION

It is an object of the invention to improve the structure of a simulated masonry panel as well as the operational steps employed to cast and assemble such panels.

It is another object of the invention to stabilize stones in a mold for casting panels and to optimize the function of sand in the mold, both for avoiding the intrusion of concrete to the front face of the panels and to better cause the sand to simulate mortar in a masonry wall.

It is a further object to provide embedded reinforcing structures that facilitate handling and mounting of cast panels, including for joining the panels in abutting relationships, and mounting the panels to face a structure using connections accessible at the face of the panels rather than only at the edges.

It is yet another object to provide a method of casting structures that are faced with stone around corners.

These and other objects are accomplished by the modular stone panels according to the invention, made to simulate assembled masonry, and mounted or assembled to form decorative walls, retaining walls, facings for structures and the like. Precast stone-faced panels are made by setting stones such as field stone having at least one relatively flat face, substantially directly on the bottom of a mold and packing sand between the stones and between the stones and the mold frame by laterally packing and sliding each stone laterally across the bottom of the mold, thereby packing the sand while substantially keeping the stones stable on the bottom of the mold. In this manner the stones do not float on a sand bed and the stone and sand are less readily displaced by concrete poured and raked over them to fill the mold. The concrete bonds part way into the packed sand, which can be facilitated according to the invention by vibration steps that cause a liquid portion of the concrete (i.e., cement and water) to diffuse part way into the sand.

Before pouring the concrete, the panels are provided with reinforcing rods to be embedded in the casting, in particular carried on coil threaded rods arranged perpendicular to the plane of the panel and provided with slab inserts that have a complementary coil thread and support the reinforcing rods. After curing, the coil threaded rods are threaded out, leaving coil threaded holes and embedded coil nuts formed by the slab inserts, that can receive a coil threaded eye bolt or panel mounting shaft, or can be left open as weep holes. The reinforcing rods can extend beyond the edges of the panel, for example to be received in a hole in an adjacent panel reserved by a plugged tube during casting, thereby forming butt joints for edgewise coupling of the panels. Alternatively or in addition, edge cavities can be provided that are filled with concrete that hardens to form a key, flowing around the ends of the reinforcing rod(s) extending into the edge cavities and locking the panels together.

In an embodiment adapting for facing around corners, a panel is cast such that alternating stones at one or more edges of the mold protrude higher than the rear concrete face of the panel. When cured, the panel is placed on that edge at a wall of the mold, and stones are packed with sand between and against the protruding stones when casting a next panel at an angle relative to the first. This interleaves the stones at the corner and faces the corner for making structures useful as wall end posts, monuments, facings for chimneys, planters, etc.

To de-emphasize and conceal parallel joints between adjacent panels, for example when building a decorative free standing wall, the stones of each panel are staggered relative to one another at two opposite edges in the mold. The panels are arranged with the unmatched edges abutting. If necessary, joints can be pointed using a mortar matching the color of the sand that remains on the faced side of the panels to further conceal the joints.

The reinforcing rods and the coil threaded nuts (slab inserts) left in the panel can receive various fixtures such as lifting eyes or other threaded fixtures for facilitating mounting to a structure or to an abutting panel at the edge or rear. Such eyes can also be attached to ends of the reinforcing rods. In one embodiment using the panels for an earth-retaining wall, an anchoring structure preferably including an earth-filled auto or truck tire can be buried in the earth and affixed to one of the coil threaded nuts. The coil threaded nuts can also be used to attach a second row of oppositely oriented faced panels or used to attach panels while working from the face or stone side. For retaining walls, the stone faced part of the wall can be limited to an upper part, the lower part being all concrete and buried in fill.

Additional objects and aspects of the invention will be apparent from the following exemplary embodiments and applications of the invention to particular construction goals.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
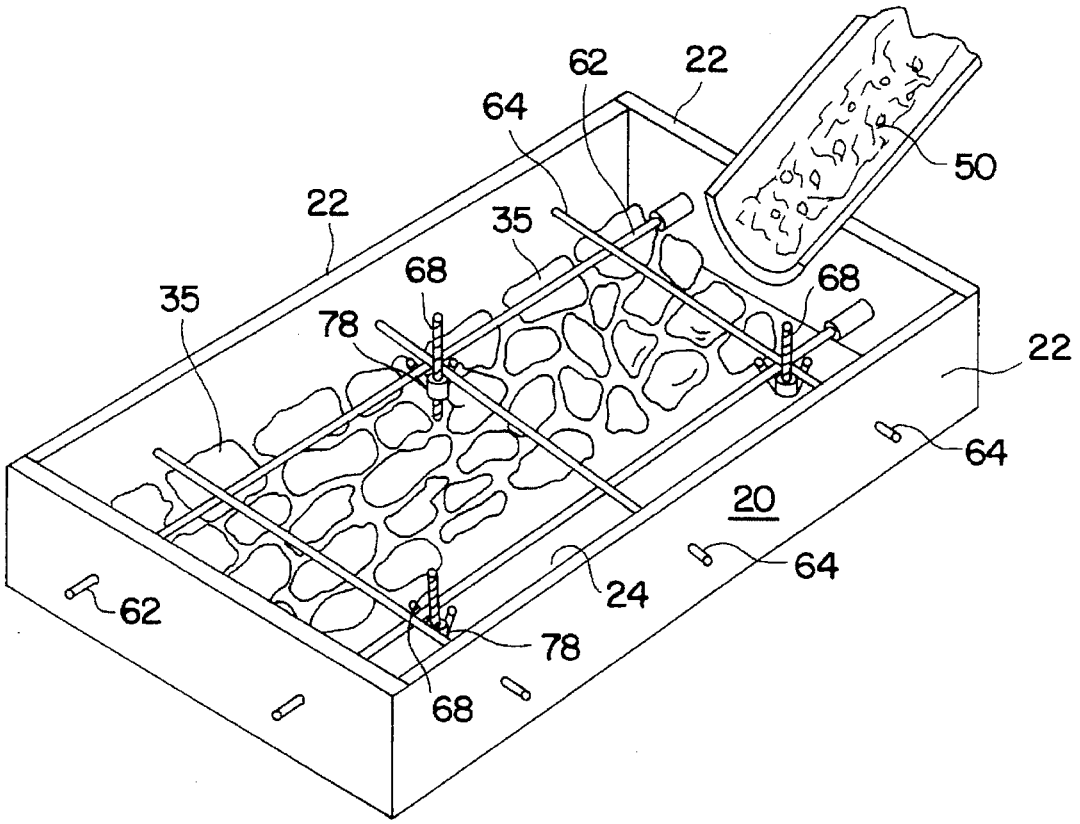
FIG. 1 is a perspective illustration of a method for making a cast panel faced with stone according to the invention.
Figure 4:
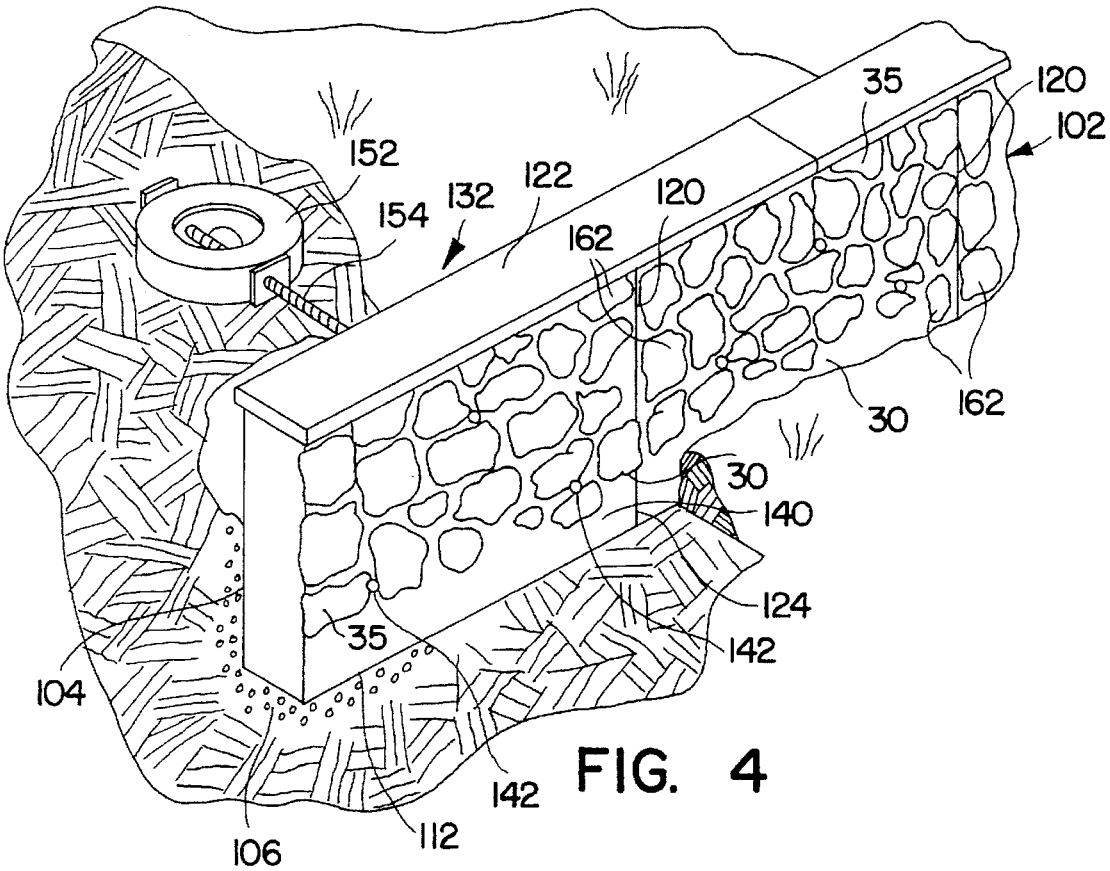
FIG. 4 is a perspective view, partly in section, showing application of the invention to a retaining wall structure.

In FIG. 1, a substantially rectangular mold 20 is formed by a number of planks forming perimeter walls 22, disposed on a flat surface defining a mold bottom 24, in this case rectangular, for making a modular building panel 30, finished panels being shown in FIG. 4. The panel is to have exposed stones 35 on one side or face, corresponding to the bottom of the mold in FIG. 1, and a cast concrete body behind the stone facing. The term "stone" is construed to include any discrete form to be partly embedded to face the panel, but natural stone is particularly apt, such as field stone, blue stone, granite, flag stone and the like. The relative dimensions of mold 20 and stones 35 can be varied. A convenient size for the panels is four by eight feet by eight inches thick (1.2 m×2.4 m×20 cm). For an eight inch thick wall the stones 35 are conveniently 1.5 to 3 inches thick (3.7 to 7.5 cm) and of varying sizes up to about one foot (30 cm) on a side.

A number of stones 35 are placed in the frame of mold 20 so as to be closely spaced. The stone can be natural or man made, but preferably has a relatively flat or at least stable lower surface 37 (see FIG. 2) so that stones 35 cannot easily rock when rested on bottom 24 of mold 20. Natural stone is somewhat irregular in shape and often has rounded surfaces 39. Stones 35 can be turned to place the flattest side down, and whether or not the stones rock can be checked and corrected if necessary when placing the stones. The tendency of some stones to rock can be dealt with by packing sand laterally under one side of the stone, but this is not preferred because it detracts from the flatness of the finished panel. Preferably, 70 to 80% of the mold surface area where stones 35 are set is characterized by direct contact between the stones and mold bottom 24, or direct contact at spaced areas circumscribing any concavities in the stones.

Figure 2:
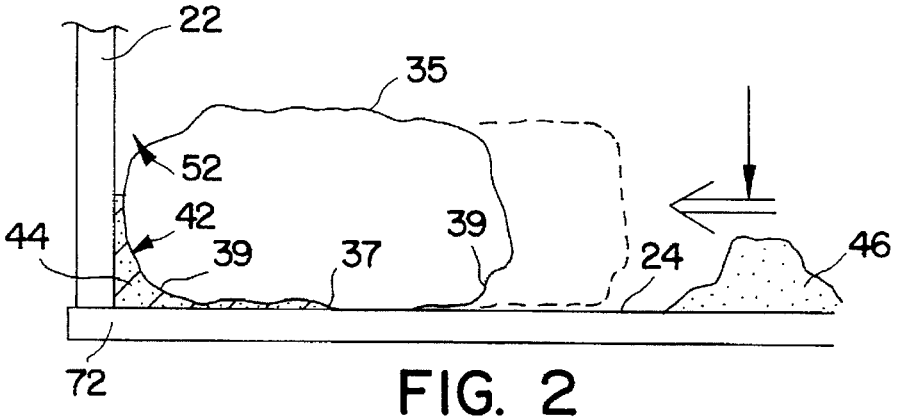
FIG. 2 is a section view through a wall of the mold frame of FIG. 1, showing setting a first stone in place.
Figure 3:
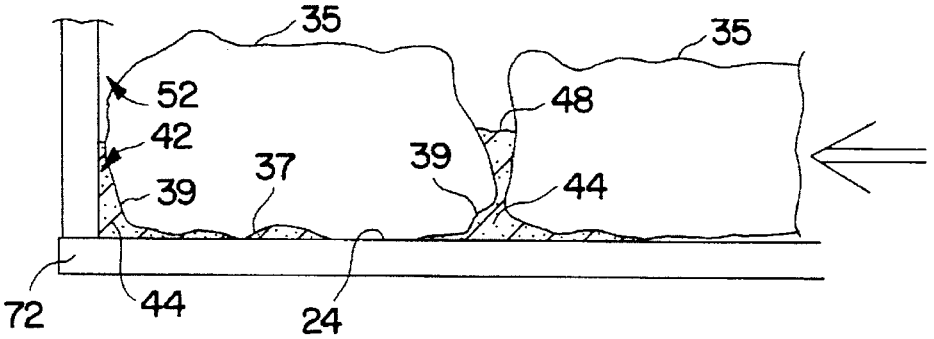
FIG. 3 is a section view corresponding to FIG. 2, illustrating the setting of the next and subsequent stones.

Although stones 35 may be placed in lateral contact or only slightly spaced from the adjacent stones, the rounded shape 39 of stones 35 as shown in FIGS. 2 and 3 is such that a downwardly-opening cavity 42 typically remains between adjacent stones and between the perimeter stones and the lower corners of the mold walls 22.

Stones 35 are placed so as to pack sand 44 tightly in downwardly opening cavities 42 between the bottom of the mold and a level 48 partway up the sides of stones 35, as shown in FIGS. 2 and 3. The tendency of the sand to pack can be enhanced by adding moisture. In any event, the sand is not placed under the stones to form a bed but rather a quantity of loose sand 46 is placed on mold bottom 24 alongside the stones in conjunction with setting individual stones 35 into place. The user can pack a corner of the mold with sand. In any event the user slides the first stone laterally against and through the quantity of loose sand 46 (see FIG. 2) to pack downward facing cavities 42 with laterally packed sand 44. Sand 44 can be placed up to about half the thickness of stones 35, e.g., two or three inches high, while keeping the stones in secure contact with the mold bottom. Some grains of sand can be caught under stone 35, but only a trace amount that is insufficient to affect the stability of stone 35 on bottom 24. The user then proceeds in the same manner to pack sand for the next stone as shown in FIG. 2, moving the next stone laterally along the mold bottom to pack a quantity of sand against and under the curve of the adjacent stones. In FIG. 1, this process is repeated to pack the stones against each of the peripheral walls 22 of mold 20 and against one another, proceeding from the corners or sides of the mold. Assuming that mold 20 is filled fully with stones, rather than partially as in FIG. 1, extra care is taken for the last stones to scrape and pack the sand laterally into the edges of the openings left for them such that setting the stone vertically into the space also packs the sand into the downwardly opening spaces 42 for the last stones. Alternatively, for structures such as standing walls and the like that will be partly buried along one edge, stones 35 can be set only part of the way across mold 20, i.e., up to the part of the panel that will be buried and not visible, as shown in FIGS. 1 and 4, in which event all of the stones are packed laterally.

After stones 35 are set, concrete 50 is poured over stones 35 and the sand 44 between them. Concrete is an aggregate of particles (e.g., small stones and sand), cement and water. Whereas the stones in mold 20 are tightly packed and supported on bottom 24 of mold 20, and spaces 42 between them are filled with packed sand 44, the concrete 50 flows and is raked over stones 35 and fills the upwardly facing cavities 52 between the stones. The concrete 50 cannot flow down to the bottom 24 of the mold, except that the more liquid portion of concrete 50 (i.e., cement and water) mixes with sand 44 between stones 35 and penetrates, for example by a half inch to an inch (1.2–2.5 cm) into the depth of the packed sand. From that point to bottom 24 of mold 20, sand 44 remains unbonded and will fall away or can be washed off after curing.

After concrete 50 has cured, the cast panel 30 is removed from mold 20, for example by detaching the peripheral walls 22 of the mold from one another. Panel 30 is lifted upright on edge, or turned over. Some of the sand adhering to panel 30 can be removed with a water spray from a hose. The sand that is not removed due to bonding with the liquid cement of concrete 50 resembles mortar joints between the stones. Sand in various colors can be used to complement the stone color and/or to enhance the mortar-like appearance of the adhering sand between the stones.

FIG. 1 illustrates a further aspect of the invention involving the use of longitudinal and lateral reinforcing rods 62, 64 embedded in the panel and carried before curing by coil threaded rods 68 disposed perpendicular to the plane of the panel. The rods 62, 64 can provide means for engaging the cured panel 30 to lift it, or means for joining the panel to other panels. The coil threaded rods 68 are removed after curing, leaving a threaded opening that can receive a coil threaded rod or bolt (e.g., an eye bolt) used in mounting or lifting the panel. In retaining walls, these threaded holes can be left open as weep holes, or can provide a location for attachment of a coil threaded rod, bolt or cable coupling, for example connected to a buried anchor or to a rear supporting surface.

Coil threaded rods 68 are set in mold 20 prior to stones 35, and the stones and sand are set around rods 68. After stones 35 are set and before pouring concrete 50, the longitudinal and lateral reinforcing rods 62, 64 are placed. The reinforcing rods 62, 64 can extend through peripheral walls 22 of mold 20 or terminate within the mold, as will be explained below. The coil threaded rods 68, which can be attached to a bottom panel 72 of mold 20 forming bottom 24, have coil threaded slab inserts 78 threaded onto them, forming spiders or ties that hold reinforcing rods 62, 64 above the bottom of the mold, preferably near a midpoint of the thickness of the panel. The slab inserts can have a closed coil spring providing the coil thread, and attached tie legs extending outwardly from threaded rods 68 to reside under rods 62, 64. Coil threaded rods, eyes, slab inserts and other complementary fixtures are available, for example, from Dayton Superior, and are available in 0.75 inch (2 cm) diameter, which is adequate for the typical loads encountered. The slab inserts 78 on their coil threaded rods are placed at junctions of the longitudinal and lateral reinforcing rods 62, 64 and hold the rods in place in the mold during casting, somewhat above the upwardly facing sides of stones 35 and approximately midway along the thickness or depth of panel 30. After concrete 50 is poured and cured, the longitudinal and lateral rods 62, 64 provide protruding parts, preferably being made of steel and enabling additional fixtures to be threaded or welded thereto. Coil threaded rods 68 are removed by unthreading them.

Rods 62, 64 are useful for making edge joints between adjacent panels. In one embodiment, the longitudinal rods 62 protrude through the mold wall and extend beyond an edge of the finished cast panel. At the opposite edge, a length of plugged PVC pipe is placed over the end of the retaining rod 62 during casting so as to extend to the edge of the panel and provide an opening in the finished panel for receiving the protruding end of a panel abutted edgewise against the first. The opening can be only slightly larger than rod 62 (e.g., a 0.75 inch or 2 cm I.D. tube can receive an 0.5 inch or 1.2 cm rod). Alternatively, the opening can be larger and arranged such that concrete or mortar can be placed in the opening with the end of the rod to better lock the panels together.

FIG. 4 shows the invention as adapted to a retaining wall 102, normally placed along a slope in the ground for providing an elongated vertical stepped surface rather than a slope. For this application, the site of the wall is excavated at least along a trench 104 along the slope. A footer 106, which can be loose gravel, or for load bearing walls a concrete slab, is set in trench 104 and the panel is placed therein so as to bury the lower edge 112 of the wall. Precast panels 30 made as discussed above are simply set vertically on edge on footer 106. In general, a plurality of precast panels 30 are set along an elongated footer 106 and connected edge to edge in butt joints 120. The connected panels 30 can be covered over by cap plates 122, preferably of the same width or slightly wider than the standing panels 30. For example for an eight inch (20 cm) thick panel 30, the cap plate is preferably one by ten inches (2.5×25 cm) cross sectionally. The cap plates can be staggered relative to panels 30 such that joints 124 between cap plates 122 do not align with the butt joints 120 between panels 30, thereby de-emphasizing joints 120 and concealing the modular nature of wall 102. After assembling wall 102, material 132 is back filled on the slope side and trench 104 is filled on the opposite side to cover over footer 106.

Panels 30 in FIG. 4 have a bottom edge part 140 that is all concrete (i.e., not faced with stones 35) because as discussed above the facing stones were not set over the entire face of mold 20. For example for a four foot (1.2 m) high panel, two feet (0.6 m) can be stone faced and the rest all concrete. The filling of earth against wall 102 conceals the concrete area 140 on the faced side of wall 102. On the rear side of the wall, gravel or similar material can form part of the back filling 132, for drainage together with footer 106. The removal of coil threaded rods 68 after casting leaves weep holes 142 through wall 102, especially where, as in FIG. 1, two of the three transverse supports 68 are placed on bottom part 140.

The hole left by the third coil threaded rod 68, which is higher on wall 102 in FIG. 4, still has the embedded slab insert and provides a means for attaching a buried anchor by means of a coil threaded connector (not shown). Preferably a coil threaded rod 154 is threaded into the hole and is threaded through coil nuts disposed at plates on either side of the anchor, which can be an auto or truck tire 152. The tire is filled with earth when the wall is backfilled, providing a substantial anchor. A coil threaded eye bolt and cable (not shown) can be used as an alternative. The anchor 152 is laterally spaced from the wall and can be disposed at or below the level of the hole of upper coil threaded rod 68 to resist the tendency for the weight of the backfilled earth and any water therein to displace wall 102, providing a passive support for the slope and the wall.

The holes for the coil threaded rods 68 can also provide a means to attach two rows of panels 30, back to back, to provide a free standing wall faced on both sides (not shown) as opposed to a backfilled wall faced on one side. For this purpose, coil threaded bolts, rods or other connectors can extend perpendicular to the plane of panels 30 to attach the two rows in parallel arrangement. Panels 30 in such rows can be staggered, and a cap plate wide enough to bridge across both rows covers the top. For additional strength, concrete can be poured into the space between the rows. Such structures can also be left open at the top and filled with earth to form planters. Connectors perpendicular to the panel and received in the coil threaded holes can also be used as a means to affix the panels as facing panels on another structure or surface such as a vertical wall of a building, a bridge abutment, to enclose a post, etc.

Referring to FIG. 4, the stones 35 in the pattern of the facing are generally staggered such that most or all of the stones 35 overlap a space between two lower stones on any vertical line, in a manner resembling a traditional masonry wall. The precast panels 30 abut at vertical joints 120 that are typically (but not necessarily) equally spaced from one another. If butt joints 120 are readily apparent, wall 102 is visibly modular and lacks some of the visual appeal of a traditional masonry wall. According to a further aspect of the invention, vertical joints 120 are concealed by one or more techniques. The lapped configuration of stones 35 tends to disguise the joints provided the panels are tightly abutted. As noted above, cap plates 122 can be set so that their joints 124 do not correspond with the panel butt joints 120. In addition, those stones 162 that are set immediately adjacent to the butt joints 120 on adjacent panels 30 are placed in a planned configuration so that the endmost stones 162 on one panel are staggered relative to those on the adjacent panel rather than at the same height. This can be done in the same way for each panel 30 made, for example always putting four endmost stones 162 of a given size at one vertical edge of each panel 30 and three endmost stones 162 at the opposite vertical edge of that panel. Thus when installing wall 102, the stones across butt joint 120 are always staggered proceeding in a horizontal line, with the three stones on one panel overlapping spaces between the four stones on the abutted panel. This further de-emphasizes butt joints 120.

In addition, butt joints 120 themselves are preferably made tight and are precisely aligned and locked together by joints formed using the protruding ends of the reinforcing rods 62, 64, which fit into complementary openings to keep the panels aligned.

Figure 5:
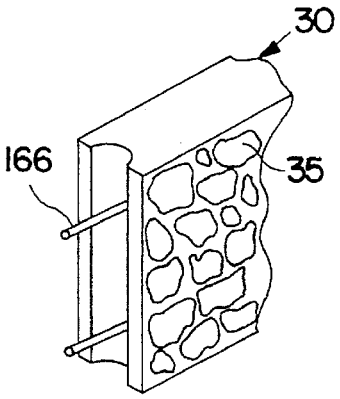
FIG. 5 is a perspective view detailing an edge of the panel for connection to another panel at a butt joint.
Figure 6:
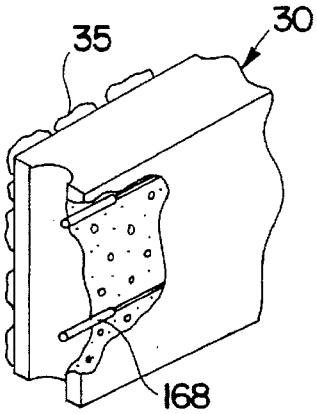
FIG. 6 is a perspective showing an opposite edge of a panel for joining with the panel of FIG. 5.
Figure 7:
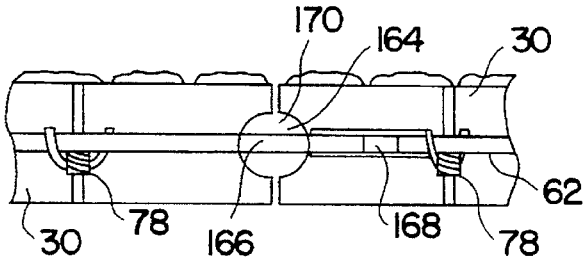
FIG. 7 is a top plan view of a butt joint according to FIGS. 5 and 6.

An alternative embodiment for the joints is shown in FIGS. 5–7. In this embodiment the joint edges of panels 30 are provided with cavities 164 extending along the panel edges. The protruding horizontal reinforcing rods 62 for successive panels 30 extend into cavities 164, and preferably further into openings coaxial with the reinforcing rods as discussed above. Cavities 164 can be made when casting panels 30 by placing a structure such as a longitudinally bisected pipe (not shown) on the inner side of mold walls 22 at the corresponding edge. The bisected pipe can have holes for receiving reinforcing rods 62 and/or pipes for providing receptacles for the protruding ends. The cavity forming pipe portion is removed after concrete 50 has cured. A male end 166 protruding from rod 62 at one edge of panel 30 passes through elongated cavity 164 (FIG. 5), and preferably the protruding end 166 engages with a female fitting 168 on the next panel (FIG. 6), which can also be attached to a reinforcing rod 62 in that panel.

The reinforcing rods 62 engaging across cavities 164 ensure that the adjacent panels 30 remain coplanar as shown in FIG. 7, thus further de-emphasizing butt joints 120 because the outer surfaces of the panels are locked in alignment. Cavities 164 of joints 120 can then be filled with a concrete slurry or mortar. Preferably a free flowing concrete slurry is inserted, whereby the concrete flows from the cavity 164 into the receptacle 168 for rigidly locking the joint and reinforcing rods 62. When cured the mortar forms a solid key 170 in each joint 120, as well as engaging rods 62. These keys 170 add strength and further assurance that each joint 120 will remain strong and aligned, as well as unlikely to develop a visible opening or crack at the joint.

Where structural strength is required, the filled-key arrangement of FIG. 7 is appropriate. In situations where the panel joints are not stressed, such as in simply decorative applications, flat butt joints can be used, preferably with protruding reinforcing rods, but potentially with the panels simply set in edgewise abutment along flat edge surfaces. In another variation, the receptacles for the protruding ends of the reinforcing rods can be provided with a rupturable container of concrete mix, for example a plastic bag. When the wall is assembled the container is pierced by the protruding part of the reinforcing rod. Over time and weather, the concrete becomes hydrolyzed and sets.

Figure 8:
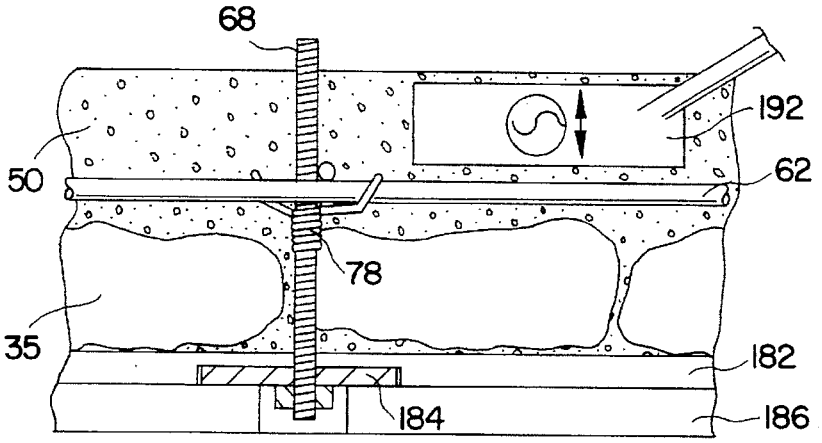
FIG. 8 is a section view through a mold as in FIG. 1, showing reinforcing rods and a vibrating mechanism.

A particularly preferred arrangement for molding individual panels 30 is shown in FIG. 8. As in the previous embodiment, mold walls 22 are disposed on a mold bottom 24. In this embodiment, however, mold bottom 24 comprises an inner (upper) sheet 182, for example of plywood, having a plurality of plates 184 therein. The plates have a central opening and a coil threaded nut welded to the underside, for attachment of coil threaded rods 68 during the casting process. The plates and nuts fix precisely the positions of the coil threaded rods 68, as well as the points at which reinforcing rods 62, 64 attach via the legs of the slab inserts 78, both laterally and longitudinally.

The inner sheet 182 forming the bottom of mold 20 is supported on an outer (lower) structure 186 providing clearance for the nuts under plates 184. The mold can generally comprise a durable wooden structure. After pouring the concrete, a motor driven vibrator 192 can be moved through the wet concrete over the rear of the stones to improve settling. Moreover, it has been found that vibrating the concrete briefly after a pour causes a more liquid portion of the concrete 50 (i.e., cement and water) to separate somewhat from the aggregate and to invade the packed sand 44 between the stones. Vibration is limited, however, to avoid displacing stones 35 set in mold 20, which could allow concrete 50 to penetrate fully through to the bottom of the mold. It has been found that with moderate vibration, sand is bonded by the cement of the concrete by about 0.5 inch (1.2 cm), leaving removable sand sufficient to allow stones 35 to protrude and to face finished panel 30. If necessary, the panel can be touched up by pointing with a sand/cement mortar.

Figure 9:
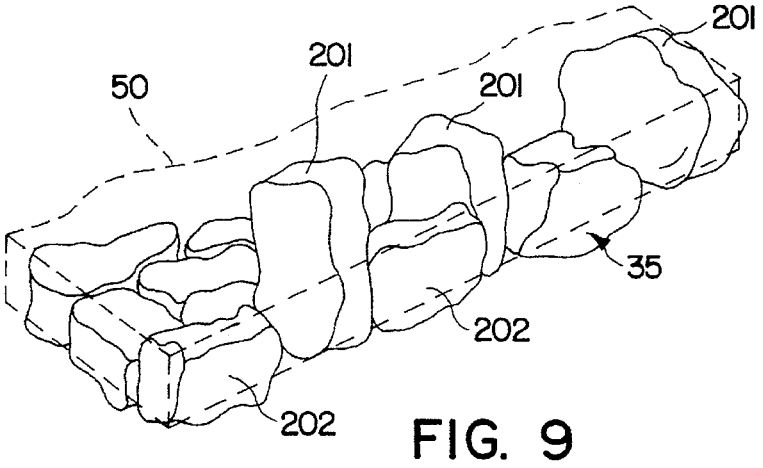
FIG. 9 is a partial perspective view through a panel in the process of molding a first panel for a corner.
Figure 10:
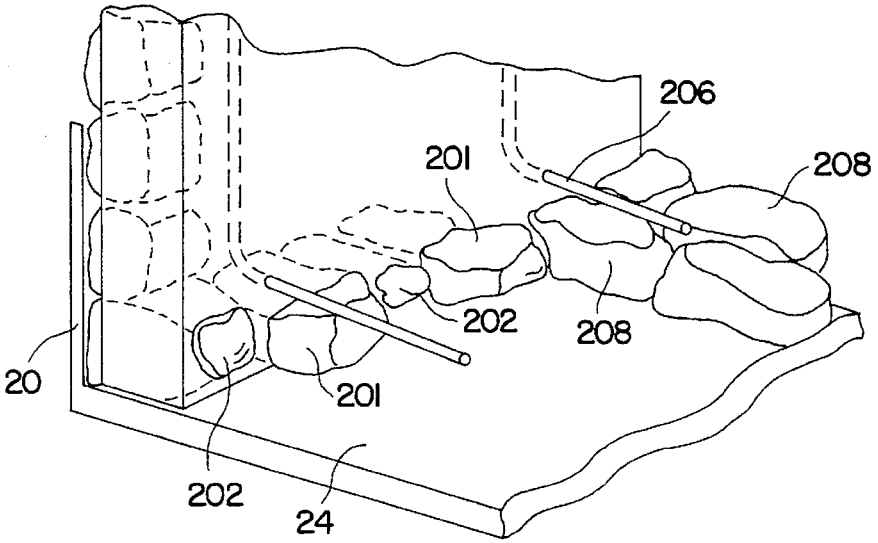
FIG. 10 is a partial perspective view showing molding a next panel of the corner.

In molding panels according to FIGS. 1–3 and 8, the concrete occupies all the volume of the panel behind or above the stones. The result is that at the edges of the panels only concrete is visible at the rear side of the edge. This is unsuitable for simulating masonry at corners, due to the visible concrete strip. According to a further inventive aspect as shown in FIGS. 9 and 10, a corner can be molded using the panel molding method as above, but arranged such that at least certain of the stones extend around the corner to avoid the solid concrete edge strip. As shown in FIG. 9, the stones for a first panel are set in the usual way except several stones 201 at the edge of the panel are set so as to protrude from the upper surface of concrete 50, shown in broken lines. For example, every other stone position is provided with a larger stone or a stone set on end, so as to protrude above the surface of the cast concrete.

The remaining stones 202 at the extreme corner of the mold preferably are also larger stones or are set on edge as compared to the remaining stones 35 that will face the panel. If these interleaved stones do not extend through or at least near to the top surface of cast concrete 50, an edge may be visible in the finished corner. To provide a true overlapping masonry appearance, larger (or edgewise) stones 201 extend substantially higher than the surface of the casting and interleaved stones 202 just slightly extend above the surface.

After casting, stones 201, and remain clear of concrete 50, and stones 202 extend near or through the surface. As shown in FIG. 10, the cast panel is set on edge in mold 20. The protruding stones 201 (and 202) are used in the manner described above together with additional stones 208 that are interleaved with the protruding ends, forming a next panel at an angle relative to the first, for example at 90°. Preferably, when casting the first panel, the reinforcing rods 206 are bent upwardly so that their ends extend into the next panel and can be attached to reinforcing rods therein (not shown in FIG. 10).

Figure 11A:
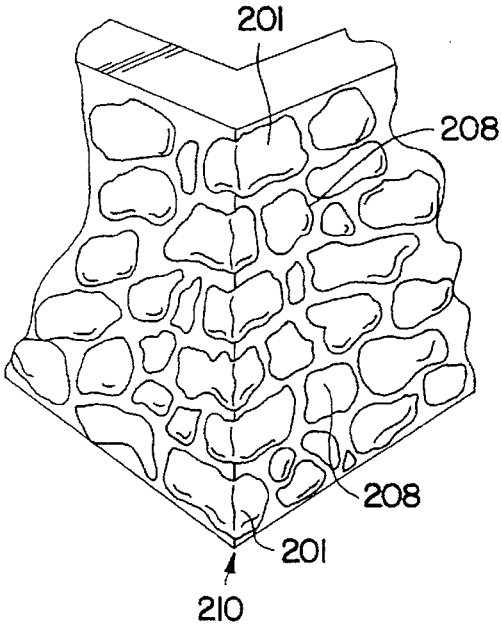
FIG. 11*a* is a perspective view showing the product formed according to FIGS. 8 and 9, and FIG. 11*b* schematically shows arrangement of the stones at the corner.
Figure 11B:
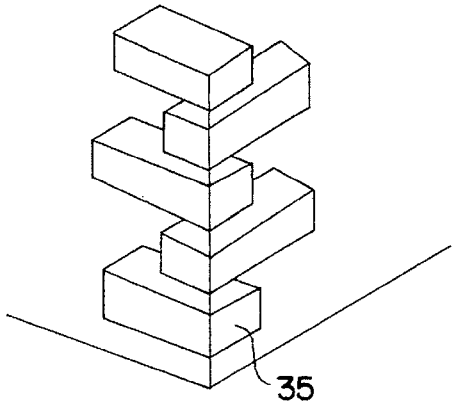

The finished corner 210 is shown in FIG. 11*a*. Stones 201 bridge around corner 210 and provide an interleaved masonry appearance. This effect is enhanced if the stones in the successive castings are interleaved as shown diagrammatically in FIG. 11*b*. This technique effectively mimics a masonry wall.

Figure 12A:
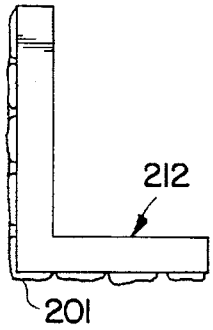
FIGS. 12*a*, 12*b* and 12*c* are plan views showing exemplary corner structures.
Figure 12B:
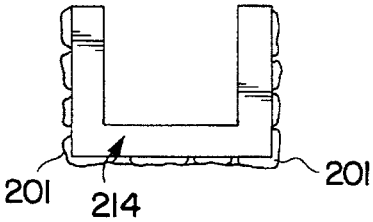
Figure 12C:
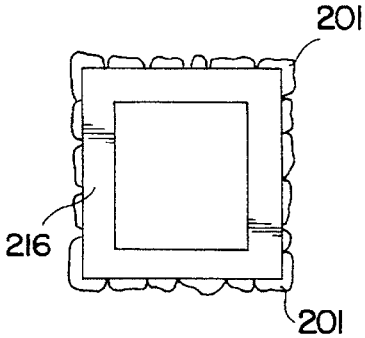

The corner forming technique of the invention can be used to form simple corners or L structures 212 as shown in plan view in FIG. 12*a*, channels 214 for partially enclosing or facing a structure such as a chimney or the like as in FIG. 12*b*, or can be formed into a closed box 216 as in FIG. 12*c*, in each case the modular nature of the panels and corners being concealed by stones 201. In addition, angles other than 90° are possible with appropriate support of the first panel when casting the next.

Figure 13A:
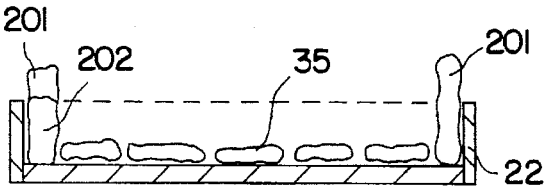
FIGS. 13*a*–13*c* are elevational views, partly in section, showing the steps of forming a closed box structure with lapped stones at the corners.
Figure 13B:
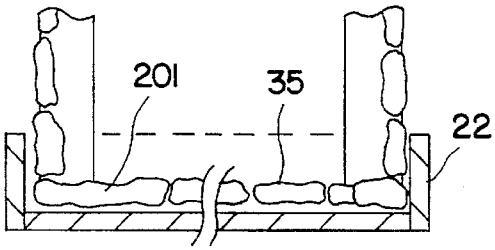
Figure 13C:
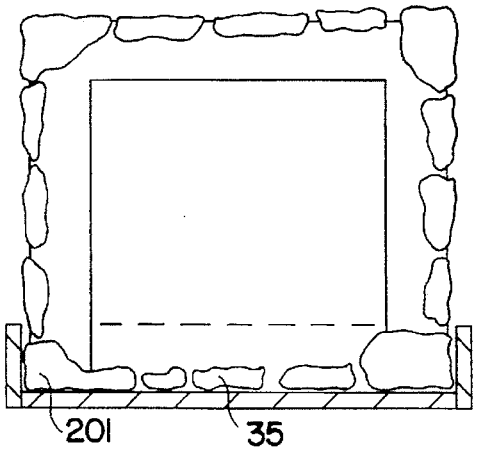

FIGS. 13*a*–13*c* are elevational views showing the steps of forming a closed box structure as in FIG. 12*c*, with lapped stones at the corners. In FIG. 13*a*, the first panel is cast as described above, except that large or protruding stones 201 are placed at two opposite edges. Two panels are cast in this manner. The cast panels are set on edge in FIG. 13*b*, again proceeding by placement and casting for stones 35 to form a panel perpendicular to the first two. The resulting channel is then inverted as in FIG. 13*c*, and the fourth casting is made in the same way to provide the closed box of FIG. 12*c*.

Figure 14:
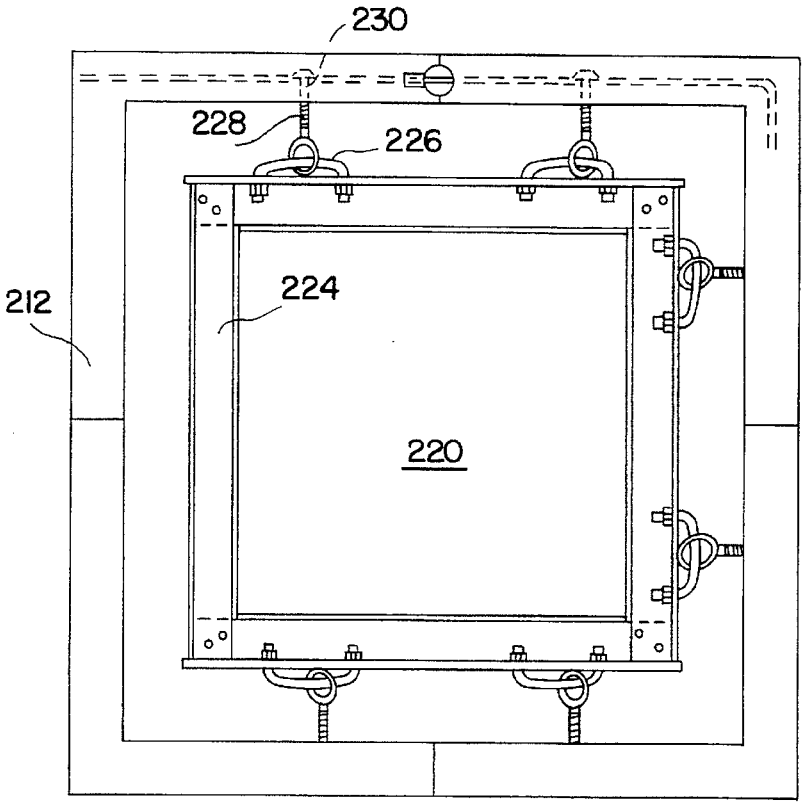
FIG. 14 is a plan view showing mounting of facing panels around a rectangular form such as a column.

The embedded coil threaded fasteners make it possible to form box structures in additional ways as well. Moreover, by threading a coil threaded bar through the panels from the front or faced side, attachments can be made to a variety of fixtures on a structure or on a frame or the like attached to a structure. In FIG. 14, for example, four cast corner elements 212 are attached to a column 220, such as a rectangular concrete column. An angle iron frame 224 is affixed around column 220 and provided with bolted-on fasteners 226, which can be of any convenient shape suitable for being hooked. A coil threaded fastener 228 with a ring structure is affixed to the fastener 226, and a coil threaded bar attaches corner elements 212 to threaded fastener 228 with sufficient tension to draw corner elements 212 into abutment around the column. If desired, the space between the corner elements 212 and column 220 can be filled with additional concrete. This frame and attachment structure can also form a hollow column (as opposed to facing a column 220), etc.

Figure 15:
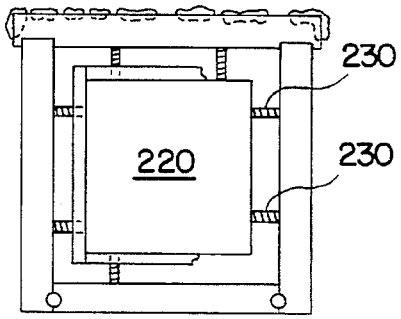
FIG. 15 is a plan view as in FIG. 14, showing an alternative panel arrangement using flat panels.
Figure 16:
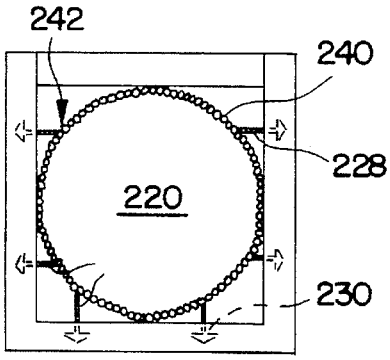
FIG. 16 is a plan view illustrating attaching faced panels to a circular column.

FIG. 15 shows an alternative panel arrangement using flat panels. The flat panels can have cavity joints as in the retaining wall, simple flat butt joints or mortise or rabbet arrangements as shown. In this embodiment, coil threaded bars 230 attach directly to the frame or to nuts. In FIG. 16, a similar facing structure is attached to a circular column 220 using a chain 240 having a clasp 242 for shortening the circumference and thereby drawing chain 240 up around column 220. Fasteners 228 as in FIG. 14 affix coil threaded bars 230 to chain 240.

Figure 17:
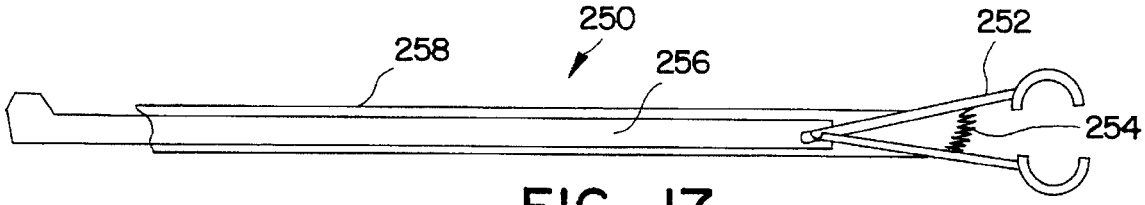
FIG. 17 shows a useful tool for manipulating the connection elements in the embodiments of FIGS. 14–16.

In an arrangement having a hanging eye type fastener 228, it may be difficult to position fastener 228 accurately to receive threaded bar 230. A spring biased tong tool 250, shown in FIG. 17, can be provided for reaching into the space between column 220 and the panels, for positioning fastener 228. Two pivoted movable end members 252 are biased by spring 254 to separate. A handle 256 attached to members 252, for example at their pivot point, is used to draw members 252 into a tube 258 for bringing members 252 together against the spring bias.

Figure 18:
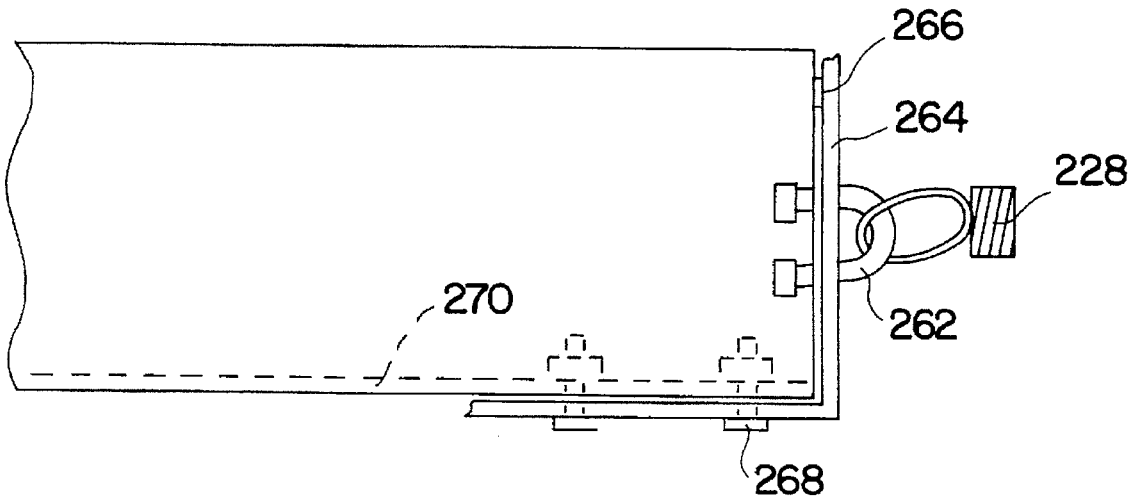
FIG. 18 is an elevation view, partly in section, showing additional alternative means for making connections to the panels.

A wide variety of specific structural connections are possible, and as shown by FIG. 18 the possibilities are not limited to connections made using the embedded coil nuts exclusively. In FIG. 18, a U-bolt 262 is attached to an angle bracket 264 that can be attached by a weld 266 and/or nut and bolt arrangements 268 to the underlying structure 270 for providing a point of attachment.

Figure 19:
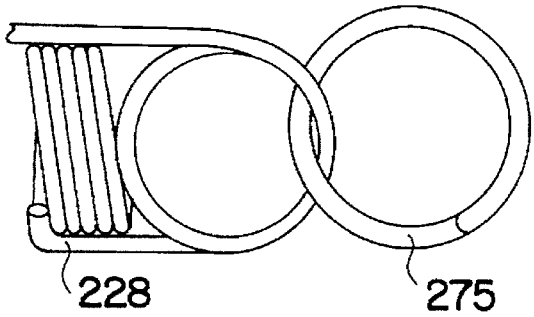
FIG. 19 illustrates a coil threaded connection element for use in making structural connections as in FIGS. 14–18.
Figure 20:
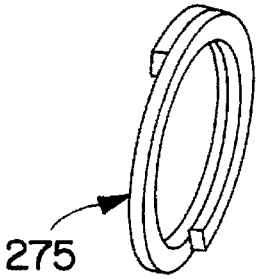
FIG. 20 is a perspective view showing a split ring for coupling to a connection element as in FIG. 19.

FIG. 19 illustrates a coil threaded fastener 228, attached to a split ring 275 for making an intermediate attachment, for example to an eye, U-bolt, chain or other open structure for mounting the panels. Ring 275 can be a C-shaped ring that is bent open and closed to provide an attachment, or as shown in FIG. 20, ring 275 can have overlapping loops such that the ring is twisted over the open structure in a manner similar to a key ring.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A method for making modular stone panels simulating assembled masonry, comprising the steps of:

providing a mold frame having a bottom and perimeter walls;

setting a first stone substantially directly on the bottom of the mold frame and placing sand adjacent to the stone;

sliding the stone laterally across the bottom of the mold frame and through the sand to one of the perimeter walls, thereby packing the sand between the stone and the perimeter wall while substantially keeping the stone supported stably on the bottom of the mold frame;

setting additional stones on the bottom of the mold frame and sliding the stones laterally across the bottom and through the sand to the perimeter walls or to at least one other of the stones, in each case packing sand against the stones and between the perimeter walls and the stones while keeping the stones supported substantially directly against the bottom of the mold frame, and continuing until an array of stones resides in at least part of the mold frame with sand packed between the stones set adjacent to the bottom of the mold frame;

pouring concrete over the stones in the mold frame, the concrete bonding part way into the sand toward the bottom of the mold frame, and allowing the concrete to cure forming a modular stone panel simulating assembled masonry; and, removing the panel from the mold frame, and removing remaining sand not bonded with the concrete.

2. The method of claim 1, further comprising vibrating the concrete after pouring and prior to curing, whereby a liquid portion of the concrete is caused to bond part way into the sand toward the bottom of the mold frame.

3. The method of claim 1, wherein the stones have at least one substantially flat face and the flat face is set against the bottom of the mold frame.

4. The method of claim 1, further comprising mounting at least one reinforcing rod in the mold frame prior to pouring the concrete, and providing access to the reinforcing rod at an edge of the panel.

5. The method of claim 4, comprising mounting a plurality of reinforcing rods in the mold frame, prior to pouring the concrete, so that the reinforcing rods extend beyond at least one of an edge of the panel.

6. The method of claim 1, comprising mounting an array of reinforcing rods in a plane parallel to the bottom of the mold frame and supporting the array of reinforcing rods on threaded rods extending transverse to a plane of the panel, and further comprising removing the threaded rods after curing of the concrete to leave a threaded hole in the panel.

7. The method of claim 6, wherein the reinforcing rods protrude at an edge of the panel, and further comprising providing receptacles for protruding portions of the reinforcing rods for attaching the panel to an adjacent panel.

8. The method of claim 6, further comprising attaching a threaded fastener to the panel via the threaded hole for at least one of lifting the panel and mounting the panel.

9. The method of claim 1, wherein the perimeter walls are rectangular and the stones are set against one of the walls and between two of the walls adjacent to one of the walls, leaving open space adjacent a fourth of the walls, whereby the panel is formed with a cast concrete section and a section faced by the stones.

10. The method of claim 1, further comprising casting a second panel at an angle relative to a first panel previously cast by the method of claim 1.

11. The method of claim 10, wherein the first panel is cast with at least one stone extending beyond a surface of the concrete at an edge of the first panel, and the second panel is cast using at least one extending stone together with additional stones, whereby the angle is concealed.

12. The method of claim 11, further comprising mounting reinforcing rods parallel to the bottom of the mold frame when forming the first panel and continuing the reinforcing rods into the second panel by bending of the reinforcing rods around the angle.

* * * * *